United States Patent [19]

May

[11] Patent Number: 5,013,084

[45] Date of Patent: May 7, 1991

[54] MECHANISM FOR HIGH-LEG RECLINING CHAIR

[75] Inventor: Teddy J. May, Tupelo, Miss.

[73] Assignee: Action Industries, Inc., Tupelo, Miss.

[21] Appl. No.: 334,221

[22] Filed: Apr. 6, 1989

[51] Int. Cl.[5] ..... A47C 1/02

[52] U.S. Cl. ..... 297/85; 297/86

[58] Field of Search ..... 297/68, 71, 75, 76, 297/83, 84, 85, 86, 87, 89, 90, 91

[56] References Cited

U.S. PATENT DOCUMENTS

| | | |
|---|---|---|
| Re. 23,375 | 4/1963 | Lorenz . |
| Re. 28,210 | 10/1974 | Re . |
| 2,857,955 | 10/1958 | De Vries et al. . |
| 2,880,784 | 4/1959 | Navelle et al. . |
| 2,914,113 | 11/1959 | Fletcher . |
| 2,948,331 | 8/1960 | Schliephacke . |
| 2,973,027 | 2/1961 | Navelle et al. . |
| 2,976,913 | 3/1961 | Schliephacke . |
| 3,135,547 | 6/1964 | Schliephacke . |
| 3,166,353 | 1/1965 | Re . |
| 3,233,938 | 2/1966 | Fletcher . |
| 3,393,007 | 7/1968 | Fletcher . |
| 3,433,527 | 3/1969 | Re . |
| 3,492,049 | 1/1970 | Fletcher . |
| 3,522,969 | 8/1970 | Re . |
| 3,572,823 | 3/1971 | Hampton . |
| 3,758,151 | 9/1973 | Re . |
| 3,767,257 | 10/1973 | Rogers, Jr. et al. . |
| 3,858,932 | 1/1975 | Crum et al. . |
| 3,937,518 | 2/1976 | Harrison . |
| 4,352,523 | 10/1982 | Holobaugh, Jr. . |
| 4,357,049 | 11/1982 | Rogers, Jr. et al. . |
| 4,410,213 | 10/1983 | Samson . |

*Primary Examiner*—Peter A. Aschenbrenner

*Attorney, Agent, or Firm*—Cushman, Darby & Cushman

[57] ABSTRACT

A pair of side mechanisms mount a back, seat and ottoman on a high-leg chair frame. Although the mechanisms are short, and require less longitudinal travel in operation, they can be used not only for chairs with two-way operation but also three-way operation. The mechanism does not protrude under the seat in use, so the frame legs may be as tall as the aesthetic design requires. The back is secure in the upright position. The sequence link of each mechanism operates on the rear pivot link of the mechanism. The ottoman linkage, including a spring, locks the ottoman in the upright position, although the lock can be overcome by the user pushing forward on the arms of the chair.

4 Claims, 5 Drawing Sheets

MECHANISM FOR HIGH-LEG RECLINING CHAIR

BACKGROUND OF THE INVENTION

Conventional high-leg reclining chairs have exposed legs 7"–8"long and high wing backs. They are either two-way or three-way operation activated by pushing on the arms for TV and full-recline positions. They are produced in two sizes, three-way mechanisms in the larger chairs and two-way mechanisms in the smaller chairs. The difference in the sizes of the two types of chairs is approximately three inches, measured from the front of the arm to the rear of the arm. The length of the arm is important to the three-way mechanism due to the movement of the center of gravity of the chair plus occupant from upright to full recline. This can cause the chair to tip backward if the arm is too short.

Also, conventional two-way and three-way high-leg recliner chair mechanisms conventionally require different frames and the mechanisms have few common parts. This becomes important when tooling new mechanisms and inventorying components for mechanisms or frames. Other complaints with existing mechanisms include linkages visible under the chair, ottomans drooping, and backs loose in the upright position.

The terms "two-way" and "three-way" are not to be confused with the term "three-position".

A three-position recliner is one which has a fully-erect, upright position in which the back is erect and the leg-rest is fully stowed, an intermediate (or "TV") position in which the back remains erect, or nearly so, but the leg-rest is at least partly raised and extended, and a reclining position, in which the back is tilted backwards and down, and the leg-rest is fully extended and raised.

A three-position chair can have either two-way or three-way operation. If the chair has two-way operation, usually the seat is fixed in relation to the back, so that the angle between them remains the same during tilting and erecting. However, if the chair has three-way operation, as the chair moves from the TV position to the fully-reclined position, the upper end of the chair back tilts down and backwards relative to the seat, and back up as the chair moves from the fully-reclined position to the TV position. Generally in a chair having two-way operation, framing components unite the chair back and seat into a common structure.

SUMMARY OF THE INVENTION

A pair of side mechanisms mount a back, seat and ottoman on a high-leg chair frame. Although the mechanisms are short, and require less longitudinal travel in operation, they can be used not only for chairs with two-way operation but also three-way operation. The mechanism does not protrude under the seat in use, so the frame legs may be as tall as the aesthetic design requires. The back is secure in the upright position. The sequence link of each mechanism operates on the rear pivot link of the mechanism. The ottoman linkage, including a spring, locks the ottoman in the upright position, although the lock can be overcome by the user pushing forward on the arms of the chair.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
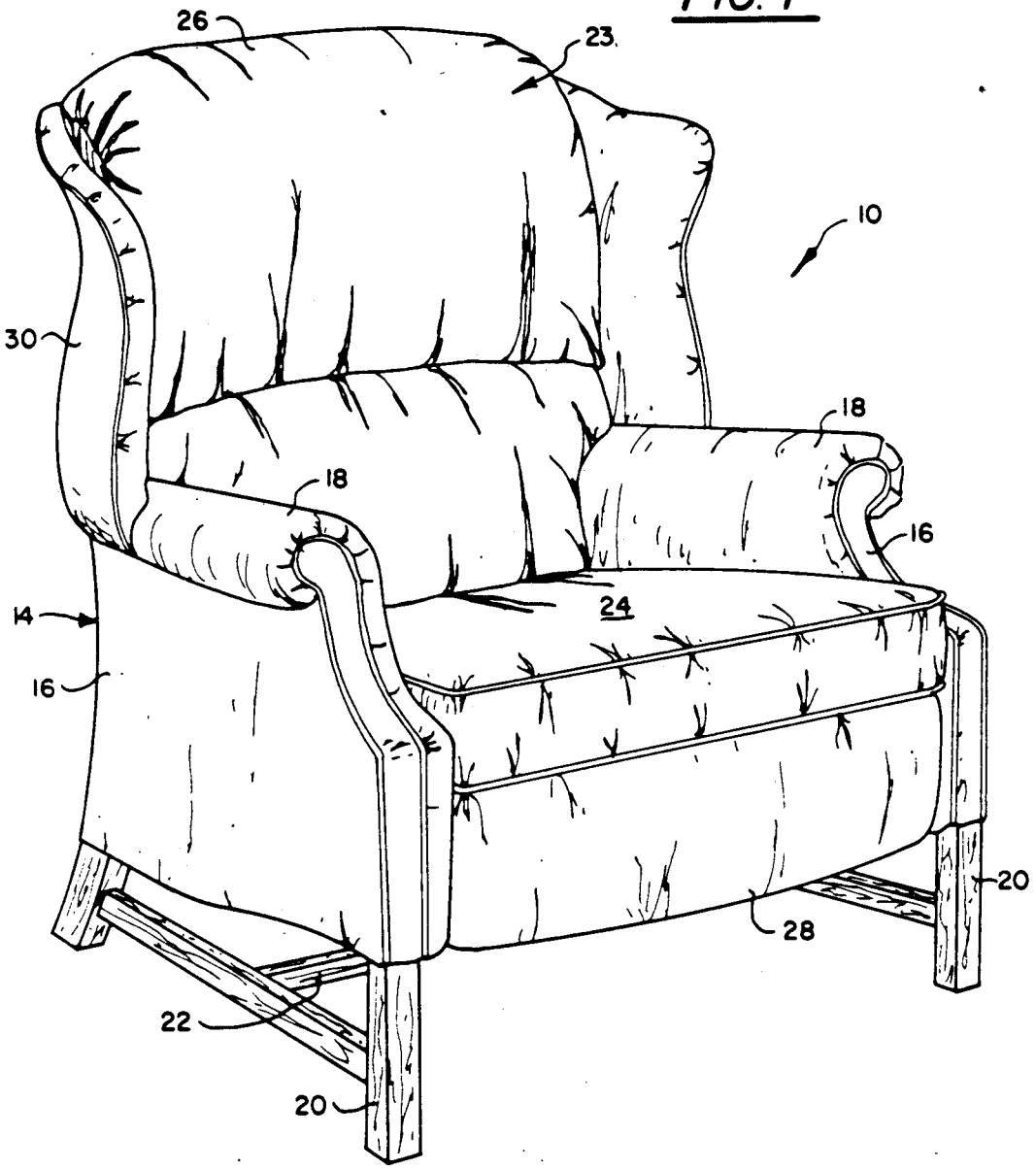
FIG. 1 a perspective view of a high-leg recliner chair in its fully-erect position.

A high-leg reclining chair is shown at 10 in a perspective view in FIG. 1.

Although the mechanism of the invention could be used in a short-leg recliner chair, the reverse is generally not true. That is, the mechanisms conventionally used in short-leg recliner chairs cannot usually be used on high-leg recliner chairs, because so much of the conventional mechanism for a conventional short-leg recliner chair protrudes under the seat and therefore would be obtrusively visible were the chair seat located far enough up off the floor that a person could see the region under the seat.

Although it is difficult to draw a distinct definitional line between a short-leg recliner chair and a high-leg recliner chair, a good working definition is that a high-leg recliner has at least five inches of leg protruding downwards to the floor from the lower edge of the ottoman when the chair is fully erect, and an overall style that permits a five foot six inch tall person to see the floor under the center of the chair when the chair is fully erect and the person is standing across the room, e.g. at a distance of fifteen feet from the chair. Often, although not essentially, a high-leg recliner has exposed wood legs, often including longitudinal (i.e., front to back) and/or transverse horizontal rungs interconnecting vertically intermediate sites on the legs and/or one another. Also, often, although not essentially, a high-leg recliner has no depending skirt around the lower margin of the upholstered frame.

For convenience in description in referring to the chair and mechanisms, the term "inboard" refers to towards the longitudinal median of the chair; "outboard" refers to the laterally, transversally outwards direction away from the longitudinal median. The terms "right" and "left" are used assuming the perspective of an occupant of the chair.

Although the chair 10 shown in FIG. 1 incorporates two of the mechanisms 12 (shown in FIGS. 2–5) or two of the mechanisms 12' (shown in FIGS. 6 and 7), these mechanisms are hidden by upholstery and other chair structure in FIG. 1. The chair 10 is shown in its fully-erect position in FIG. 1. In this position, the chair back is up, and the ottoman is stowed. The chair 10 in its fully-erect position bears a close resemblance to a non-reclining high-leg upholstered chair, in this instance to a wing back, upholstered library chair of an updated yet traditional style.

The chair 10 includes an upholstered base frame 14 which includes left and right generally vertical sides 16 topped by generally horizontal, longitudinally extending arms, 18 (in this instance upholstered, rolled arms), a set of depending legs 20 for supporting the chair on a floor and various transversally extending components (not all of which are shown, but which are represented by the transverse rung 22) which connect the left and right sides of the frame and provide structural and aesthetic integrity for the chair base.

The chair base frame 14 is shown being upholstered, as are the other components (apart from the mechanisms 12, which will be described below). Conventional upholstery 23 of cloth and/or leather may be used, as may be synthetic sheets and composites such as "vinyl" upholstery. The mechanisms of the invention impose no particular limitations on the materials that the chair can be made of, as it is believed a person of ordinary skill in the art will readily understand. Preferred materials used for manufacturing the chair (apart from the mechanisms) include particle board, wood, mechanical fasteners, adhesive, batting, foamed plastic, chair springs, non-woven fiber, cloth and miscellaneous hardware. The mechanisms are preferably predominately made of links cut and bent from steel plate and painted matte black, these being interpivoted, connected and stopped by steel pins and rivets, with bushings of lubricous plastic sheet material interposed between members of joints. Springs are made of spring steel.

The mechanisms 12 have as one function securing various main parts of the chair together as an operative unit.

The main parts include, in addition to the upholstered base frame 14, a seat 24, a back 26 and an ottoman 28 (which some people would call a leg-rest or a foot-rest). It is conventional for recliner chairs to have two-part ottomans, i.e. a primary ottoman 28 (the one that shows in FIG. 1) and a secondary ottoman which, in the fully-erect position of the chair may be hidden under, in back of and/or behind the primary ottoman. The chair shown in FIG. 1 preferably has a secondary ottoman, and, as can be deduced from FIGS. 2–4, in the fully-erect position of the chair, it is substantially hidden from sight in a downwards-facing orientation closely under the seat about eight inches behind the back of the primary ottoman.

The chair back need not have wings 30, but wings on such chairs are a popular feature. In some high-leg recliners, the seat comprises an underlying support attached to the side mechanisms and surmounted by a loose cushion. In other instances, the support structure and cushion are built into a unitary assembly which is mounted as a whole to the side mechanisms.

In the chair 10 provided with the mechanisms of the present invention, there is preferably no hand crank or motor for operating the chair. Rather, the fully-erect chair is operated by an occupant by pushing forwards on the arms relative to the seat to extend the ottoman and move the seat somewhat forwards relative to the base to achieve the TV position. In instances where the chair 10 is a three-position chair, full recline is achieved from the TV position, by the occupant by pushing back with his or her shoulders on the upper part of the chair back, causing the chair back to tilt down relative to the base (and also lowering the seat relative to the base), thereby lowering the chair/occupant composite center of gravity as reclining of the back shifts the composite center of gravity rearwardly, thereby preserving tolerable stability, despite the fact that the chair is a high-leg chair.

The mechanisms 12 as adapted for three-way operation will be described in detail with reference to FIGS. 1–5. Then the differences of the mechanisms 12' as adapted for two-way operation will be described with reference to FIGS. 1, 6 and 7.

Figure 2:
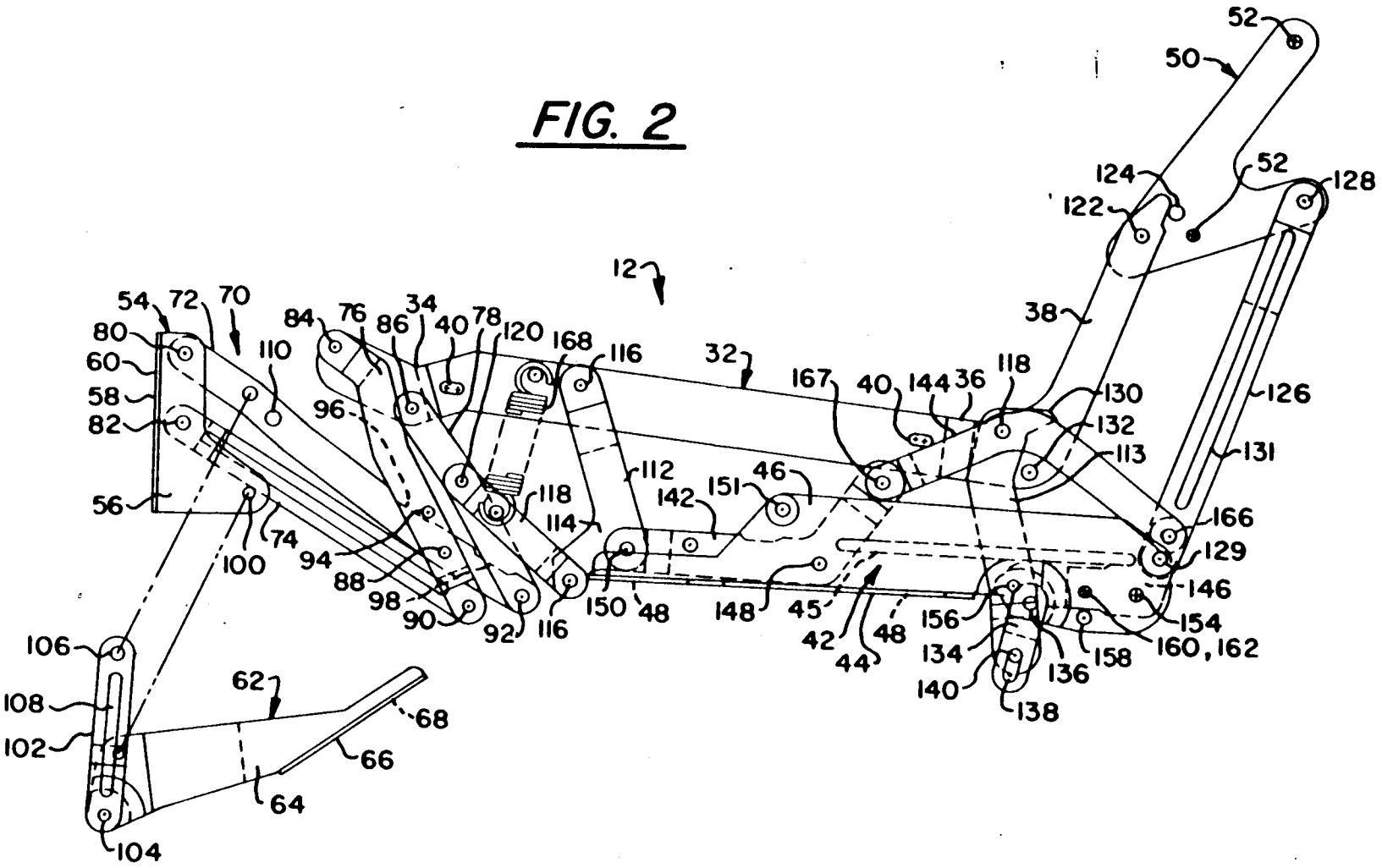
FIG. 2 is a side elevation view of one side mechanism, particularly showing the inboard side of a right side mechanism in its fully-erect position and adapted for three-way operation.
Figure 3:
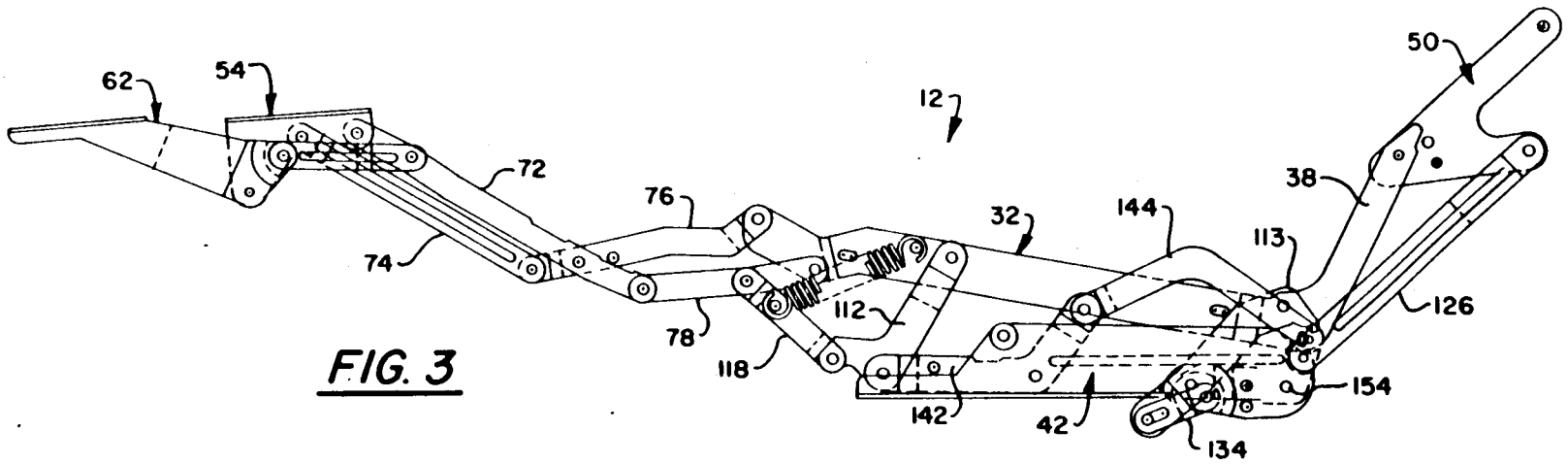
FIG. 3 is a side elevation view of the mechanism of FIG. 2 in its TV position.
Figure 4:
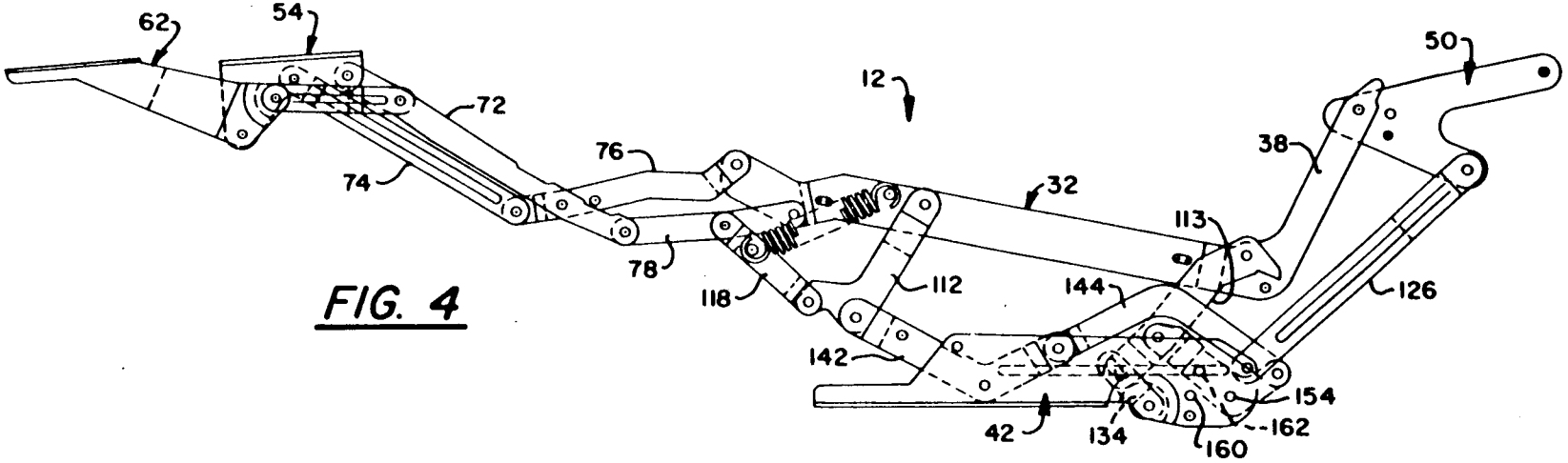
FIG. 4 a side elevation view of the mechanism of FIGS. 2 and 3 in its fully-reclined position.

The mechanism 12 shown in FIGS. 2–4 is a right side mechanism. The chair 10 is provided with both a left side mechanism and a right side mechanism, one being a mirror image of the other, each being comparably mounted to the chair parts and the two coacting as the chair is operated.

The mechanism 12 includes a long, upper longitudinal link 32, which, like all the links to be described is preferably stamped, bent and punched or drilled from metal plate. The links are preferably planar, except that many of them have one or more shallow-S double bends in them, where necessary to prevent them from interfering with position or intended loci of movement of one another. Thus, for instance, the forward end portion of the link 32 jogs inboard by one thickness at 34 and the rear portion thereof jogs inboard by three thicknesses at 36, both compared with the central portion of the long link 32. The rear portion of the link 32 is shaped as an upwardly projecting spur 38.

The central portion of the long link 32 is shown provided with a series of holes 40 to receive fasteners for fastening the mechanism to a respective side of the seat 24 of the chair.

The mechanism 12 further includes a base-mounting bracket 42 which is provided by a link folded along a longitudinal axis so as to have an outboard vertically-oriented, longitudinally-extending flange 44 which extends throughout approximately the rear eighty percent of the bracket 42, and a generally horizontally, inboard-extending flange 46 at the lower extent of the flange 44, which extends throughout approximately the foremost two-thirds of the bracket 42. The flange 46 is provided with a series of holes 48 to receive fasteners for fastening a respective side 16 of the base frame 14 to the mechanism 12. The flange 44 is located inboard of the central portion of the long frame-mounting link 32 by about seven link thicknesses.

The feature indicated on the flange 44 is not a slot; rather it is an outboard-facing groove embossed in the link, which causes a corresponding low ridge extending along the inboard face of the flange 44, the purpose of such embossment being to impart improved anti-bending strength to this link. (Other links are shown having similar embossments, as will be briefly pointed out as the respective links are introduced in the description below.)

The link shown located furthest outboard on the mechanism 12 is the flat, V-shaped back-mounting link 50, located on the outboard side of the spur 38 of the seat-mounting link 32. The link 50 is shown provided through the thickness thereof with a series of vertically spaced holes 52 for receiving fasteners for securing the link to a respective edge of the chair back 26.

At its forward end (when in the closed position shown in FIG. 2, equating to the fully erect position of the chair), the mechanism 12 has a primary ottoman mounting bracket 54 in the form of a link folded along a line which is substantially vertical when the mechanism is in its closed position, so as to have a rearwardly-projecting longitudinal flange 56 and, at its forward margin, an inboard-projecting flange 58 provided with a series of vertically spaced openings 60 for mounting a corresponding end of the primary ottoman 28 thereto.

By preference, the chair 10 further includes a secondary ottoman (not shown in FIG. 1, but described above), and, for mounting it, the mechanism preferably includes a secondary ottoman mounting bracket 62. This bracket is shown comprising another link folded along a longitudinal fold line so as to have an elongated, vertical-plane flange 64 and, along its rear third, an inboard-extending flange 66. The latter is provided with a series of holes 68 for mounting a corresponding end of a secondary ottoman thereto. The flange 64 has a jog from about ten percent of the way back, to about half-way back from its front end, which places its rear portion in a plane about seven link-material thicknesses inboard of its front portion.

The links and brackets by which the mechanisms 12 unite the chair into a unitary structure carried on the chair base have all been introduced above; the remainder of the description relates how the links and brackets of a mechanism 12 are interconnected and how they interact in use. Unless the contrary appears, all of the rivets, pivot joints and pins described below have transverse horizontally-extending main axes (i.e., their own longitudinal axes extend crosswise of the chair and are horizontal). Even if not specifically mentioned, any of the pivot joints can include washer-like bushings, e.g. made of a lubricous synthetic plastic material such as nylon, between the interpivoted parts and/or between the pivot pin head and/or upset tail and the respective adjacent part. And any stop pin or mounting pin may be a plain metal pin, or, where cushioning or noise-reduction is a consideration, a metal pin sleeved with a tubular bushing of lubricous synthetic plastic material such as nylon.

A multiple-link lazy tongs-type linkage 70 is provided at the front end of the seat-mounting link 32 for mounting the primary and secondary ottoman-mounting brackets 54 and 62.

The linkage 70 is shown comprising upper and lower forward links 72, 74 and upper and lower rear links 76, 78.

The front ends of the upper and lower forward links 72, 74 are connected one above the other (in the closed position of the mechanism) to the longitudinal flange of the primary ottoman mounting bracket by respective pivot joints 80, 82.

The rear ends of the upper and lower rear links 76, 78 are connected one in front of and above the other to the forward portion of the seat-mounting link 32 by respective pivot joints 84, 86.

A pivot joint 88 is provided where the upper forward link crosses the upper rear link, located approximately eighty percent down from the upper ends of these links. The lower end of the lower front link is connected to the lower end of the upper rear link by a pivot joint 90, and the lower end of the upper front link is connected to the lower end of the lower rear link by a pivot joint 92. In the preferred embodiment, the upper rear link is flat, the central approximately eighty percent of the lower front link is jogged outboards by about two link thicknesses, and the upper approximately twenty percent of the upper and lower rear links are jogged outboards by about three link thicknesses.

An inboard-extending pin 94 provided on the upper rear link about one-third back from its front end is available to engage the upper edge of the upper front link at 96 and 98 to provide respective stops limiting retraction and extension of the lazy tongs linkage as the primary ottoman is stowed and deployed.

Below where the front end of the lower front link mounts to the longitudinal flange of the primary ottoman-mounting bracket, a pivot joint 100 connects the heel of the foot of the longitudinal flange of the secondary ottoman-mounting bracket to the primary ottoman-mounting bracket.

A secondary ottoman operator link 102 is provided having one end connected by a pivot joint 104 to the toe of the foot of the longitudinal flange of the secondary ottoman-mounting bracket (at a location that is spaced generally directly vertically below the pivot joint 100 by about an inch and a half when the mechanism 12 is in its fully closed position). The opposite end of the operator link 102 is connected by a pivot joint 106 to the upper front link about twenty percent back from the front end of the upper front link. Accordingly, as the primary ottoman 28 is extended from its stowed, on edge, location under the front lip of the seat 24, the operator link 102 swings the secondary ottoman-mounting bracket through almost one hundred eighty degrees, from being located occupant's leg support-face down, up under the seat behind the primary ottoman, to right-side-up, and in a common, slightly tilted forwards plane with the primary ottoman, out front of the primary ottoman, e.g. by about three inches.

The feature 108 is a stiffening ridge impressed in the link 102.

An inboard-extending pin 110 provided on the upper front link below and to the rear of the pivot joint 106, about an inch away from the pivot joint 106, in a position to act as a secondary stop limiting travel of the secondary ottoman upon retraction, by engagement with an edge of the secondary ottoman operator link 102.

The seat-mounting link 32 is shown provided with front and rear depending links 112, 113 respectively connected at their upper ends to the central portion of the link 32 about one-third back from the front end of the link 32 by a pivot joint 116, and to the base of the spur 38 near the rear end of the link 32 by a pivot joint 118.

The front depending link 112 is generally L-shaped, with a depending stem and a lower leg 114 projecting forwards. The lower sixty percent of the link 112 is jogged inboards about four link thicknesses compared to the upper twenty percent thereof. The forward end of the lower leg 114 of the link 112 includes an angled downwards toe (located in the same plane as all of the leg 114), on which is provided a pivot joint 116.

An ottoman lazy tongs operator link 118 has a rear, lower end connected to the toe of the front depending link 112 by the pivot joint 116, and a front, upper end connected to a site on the lower rear link of the lazy tongs about forty percent of the way down from the upper end of that link, by a pivot joint 120.

Accordingly, when the front depending link swings forwards about its upper end, the operator link 118 has its rear, lower end pushed towards the pivot joints by which the upper and lower rear links are connected to the base-mounting link 32, thereby extending the lazy tongs and thrusting the ottoman. The reverse happens as the front depending link swings rearwards about its upper end.

The back-mounting link 50 is a generally V-shaped link the rear leg of which is shown being somewhat less tall than the forward leg thereof. One of the holes for mounting the back is shown provided at the upper end of the forward leg, and the other is shown provided about forty percent up the rear leg from the lower end. The back-mounting link is shown connected near its lower end, in the region where its legs join, to the spur 38 of the seat-mounting link 32, near the upper end of the spur 38, by a pivot joint 122.

About three-quarters of an inch about the joint 122, the link 50 is provided with an inboard-projecting pin 124 which is available to engage the rear edge of the spur 38 above the joint 122 as the chair is erected for defining the location of the back in the fully-erect position of the chair and helping to maintain the back tightly in place in the closed position of the mechanism.

The mechanism 12 further includes an operator link 126 for the back-mounting link. The operator link 126 has an upper end connected to the upper end of the rear leg of the back-mounting link 50 by a pivot joint 128, and a lower end connected to the rear end of the vertical, longitudinal flange of the base-mounting bracket 42 by a pivot joint 130. Accordingly, when the base-mounting bracket 42 translates forwards relative to the seat-mounting link 32, and the latter tips upwards to the front slightly as the mechanism opens from the fully closed (FIG. 2) to the TV position (FIG. 3), the operator link 126 mainly merely pivots forwards around its upper end, but also is pulled slightly downwards in a translational sense, so that the back-mounting link 50 tilts slightly to the rear, thus slightly tilting the back of the chair.

The upper ten percent of the operator link 126 is jogged about five link-thicknesses outboards relative to the lowest two-thirds of that link. 128 indicates an impressed stiffening ridge.

If the chair 10 is provided to have a third, fully-reclined position (FIG. 3), in achieving this position from the TV position (by means hereinafter more fully described), the front of the seat-mounting bracket raises about one and a quarter inches, and the rear of the seat-mounting bracket raises about one half of an inch and the seat mounting bracket swings rearwards about one-quarter of an inch. This action, in combination, pulls downwards and forwards on the back-mounting link operating link 126, causing the latter to rotate rearwardly about its connection to the spur 38 by about fifteen degrees, thereby reclining the chair back.

The remaining structure of the mechanism 12 mounts the base-mounting bracket to the seat-mounting link 32 and operates the base-mounting bracket 42 in relation to the seat-mounting link, also causing operation of ottoman and chair back as has been described above. The remaining structure of the mechanism 12 is the most difficult to visualize because it is, in general, sandwiched between the longitudinal flange of the base-mounting bracket 42 and the seat-mounting link 42.

The upper end of the rear depending link 113 is shown provided with a rearwardly-extending prong 130. The base link 32 is shown provided at the base of the spur 38, behind and below the pivot joint connecting the upper end of the rear depending link 113 to the seat-mounting link 32, with an inboards-extending pin 132. The pin 132 engages the lower edge of the prong 130 to limit forwards swinging of the rear depending link (and therefore the front depending link 112 and the seat-mounting bracket) relative to the seat-mounting link 32, as the mechanism 12 opens from the closed to the TV position thereof.

A longitudinally short control link 134 is connected by its upper, rear end to the vertical longitudinal flange of the base-mounting bracket 42 about twenty-five percent forwards from the rear end of the base-mounting bracket 42 and about one-fourth of an inch below the inboards-extending flange of the base-mounting bracket 42, by a pivot joint 136. The link 134 is about two inches long. Its forward, lower inch is jogged outboards relative to its rear, upper inch by about three link thicknesses. That outer portion is provided with a slot 138, elongated along the length of the link 134, and a sliding, pivotal connection is made between such portion and the lower end of the rear depending link 113 by a pivot joint 140 which can slide along the slot 138.

When the mechanism 12 is closed, the link 134 projects downwards and slightly forwards and the pivot joint 140 is located at the upper end of the slot 138. As the mechanism opens from the closed position (FIG. 2) to the TV position (FIG. 3), the link 134 pivots forwards about fifty degrees about its upper end as the pivot joint 140 slides to bottom of the slot 138. As the mechanism moves from the TV position to the fully-reclined position, the link rotates approximately seventy degrees further in the same direction (so that the control link projects upwards and forwards at about a forty-five degree angle) and the pivot joint 140 slides back to the same end of the slot it occupied in the closed (FIG. 2) position. (Because the control link has rotated so much between its FIG. 2 and FIG. 4 positions that it has become generally inverted, the lower end of the slot 138 in FIG. 2 will be called its outer end, and the upper end of the slot 138 in FIG. 2 will be called its inner end, both relative to the pivot joint 136.)

The mechanism 12 further includes three boomerang (or arcuate)-shaped links, namely a forward long one 142, which is concave upwards, a rear long one 144, which is concave downwards, and, under the rear half of the rear long arcuate link, a rear short arcuate link 146, which is concave upwards.

The forward upwardly-concave arcuate link 142 is connected in its central elbow region to the vertical longitudinal flange of the base-mounting bracket 42 near the fold line of the base-mounting bracket, about one-third of the way back from the front end of the base-mounting bracket, by a pivot joint 148. The front end portion (about three-quarters of an inch) of the link 142 is jogged outboards by about two link thicknesses, and about the same amount of the rear end portion is jogged outboards by about one link thickness.

The front end of the link 146 is connected to the base of the upright standard of the front depending link 112 by a pivot joint 150.

In the closed position (and in the TV position), an inboards-projecting pin 152 provided on the front arm of the link 142 about two-thirds of the way forwards along that arm from the pivot joint 148, engages on a recessed upper edge region of the vertical longitudinal flange of the seat-mounting bracket.

In the fully-reclined position (FIGS. 4 and 5), an upper edge portion of the link 142, forwardly of the pivot joint 148, engages an outboards-extending pin provided on the vertical, longitudinal flange of the base-mounting bracket for limiting tilting-down of the back and raising of the seat, both relative to the base-mounting link 32.

The rear upwardly-concave link 146 is connected at its central bend to the vertical, longitudinal flange of the base-mounting bracket at the rear end of the latter, below the connection of the lower end of the back-operating link to that flange, by a pivot joint 154.

The forward end of the rear upwardly-concave link 146 is connected to the rear depending link about forty percent of the way up from the lower end of the latter, by a pivot joint 156.

The link 146 remains immobile as the mechanism moves between its fully closed (FIG. 2) and TV (FIG. 3) positions, with an outboards-projecting pin 158 on the vertical, longitudinal flange of the base-mounting bracket 42 engaging the lower edge of the link 146 approximately midway between the pivot joints 148 and 156.

The mechanism 12 is shown provided with aligned openings 160, 162 through the vertical, longitudinal flange of the base-mounting bracket 42 above the pin 158 and through the link 146. For restricting the chair 10 to having only a fully-erect and a TV position, a rivet 164 can be installed through the aligned openings 160, 162, as well.

The rear, concave-downwards link 144 has its rear end connected to the rear end of the link 146 by a pivot joint 166 and its front end connected to the rear end of the forward concave-upwards link 142 by a pivot joint 166. The links 142, 144 and 146 remain immobile as the mechanism moves between its closed (FIG. 2) and TV (FIG. 3) positions.

As the mechanism moves from the TV position (FIG. 3) to the fully-reclined position (FIG. 4), the forward, upwardly-arcuate link rocks towards the rear about its central pivot joint, thus raising the front of the seat-mounting link 32 relative to the base-mounting bracket 42, shifting the rear, downwardly-concave link 144 rearwards, thereby raising the rear of the seat-mounting link 32.

The raising of the rear of the seat-mounting link pulls down the lower end of the back-operating link, thereby fully reclining the chair back.

When the mechanism is in its TV position (FIG. 3), the ottoman can be retracted by the occupant by pulling backwards with his or her heels on the front edge of the primary ottoman, while pushing forwards on the arms of the chair. However, when the chair is in its fully-reclined position, the pivotal connection of the front end of the rear upwardly-concave link to the intermediate location on the rear depending link forces the pivot joint at the lower end of the rear depending link along the slot in which it is mounted, to the inner end of that slot, and the angular orientation of the link in which the slot is provided then prevents the rear depending link from swinging about its upper end pivot joint, thus preventing the ottoman from being retracted. In other words, the ottoman-mounting lazy tongs is locked in an extended condition so long as the chair back is fully reclined.

In the preferred embodiment, the seat-mounting link is about sixteen inches long (as projected onto a horizontal, longitudinally-extending line, i.e., not adding five more inches for the distance up the spur 38, but only the about two inches that the spur projects rearwards of its own base on the link 32).

Erecting the chair from a reclined position, to a TV position, and to a fully-erect position involves a reversal of the steps explained above. The weight of the person, concentrating on the seat, pushes the seat down, pulling up the back, whereupon ottoman retraction is assisted by the person's heels.

The tension coil spring 168 mounted between pins provided on the seat-mounting link 32 ahead of the pivot joint 116 and an intermediate location on the ottoman lazy tongs operator link 118 acts as the ottoman is retracted to keep the primary ottoman firmly retracted in its stowed position, shown in FIG. 1.

Figure 5:
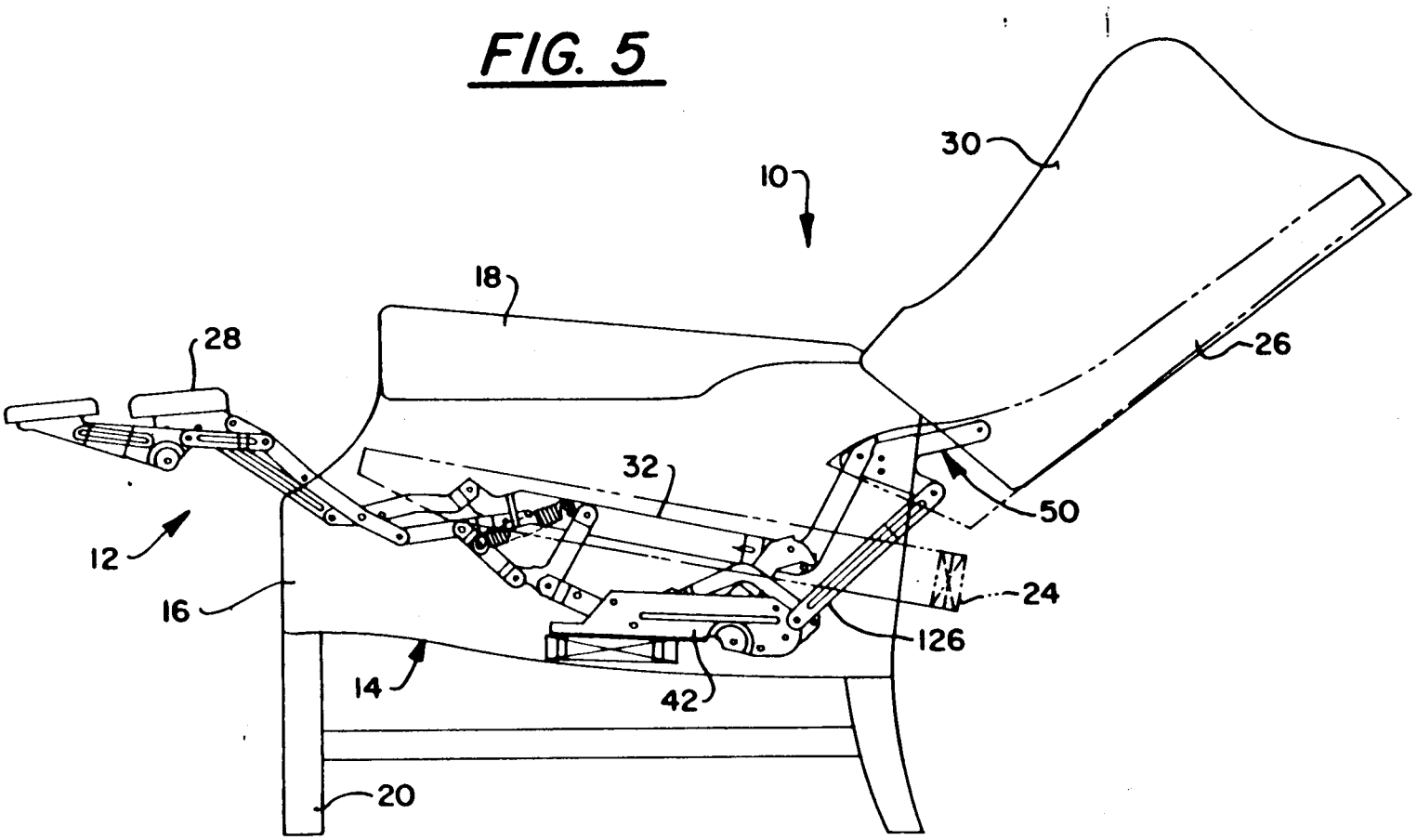
FIG. 5 is a side elevation view of the chair of FIG. 1, with its mechanisms in the three-way fully-reclined position shown in FIG. 4.
Figure 6:
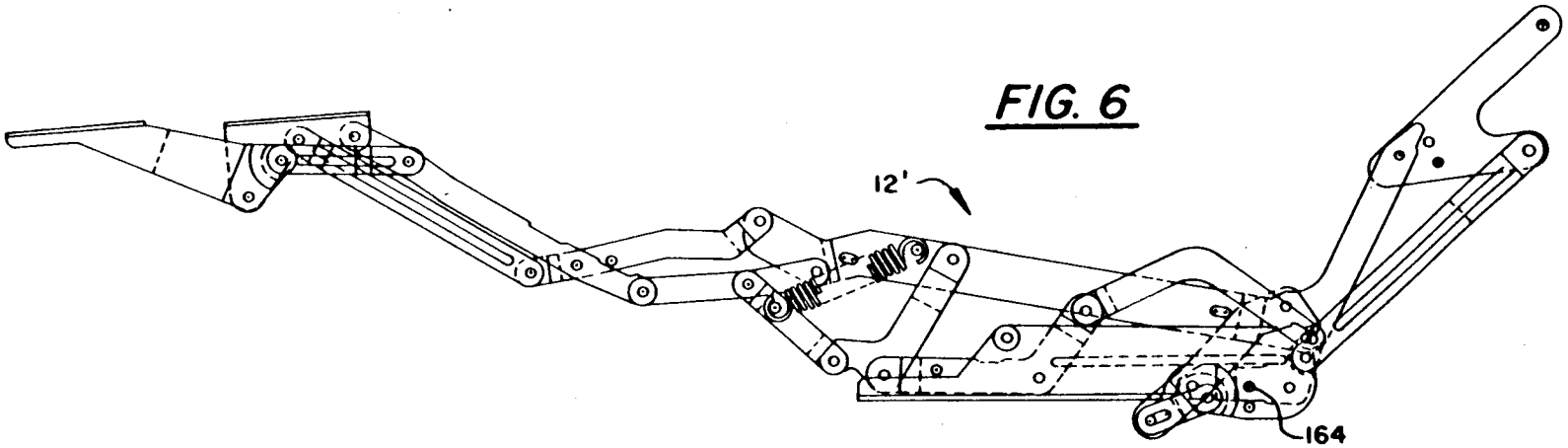
FIG. 6 is a side elevation view of the same mechanism as shown in FIGS. 2–4, but adapted for two-way operation (by alternative mounting of one pivot pin), and shown in its fully-reclined position.

The mechanism 12' shown in FIGS. 6 and 12 is exactly like the mechanism 12 as described in relation to FIGS. 1–5, except that the pivot joint 154 is omitted, but the pivot pin 164 is installed in the openings 160, 162, for mounting the rear, upwardly-concave link 146 to the base-mounting bracket 42 at a correspondingly different (shorter) distance relative to the pivot joint 136 of the short, slotted link 134 to the base-mounting bracket 42.

The mechanism 12' is mounted to a chair 10 in the same manner as has been described in relation to FIGS. 1–5. However, due to the single difference in the placement of the pivot joint which has just been described, as the chair is fully reclined from the TV position, the relationship of the seat to the back remains the same (or nearly so), so that the mechanism 12' thereby provides a two-way, three-position chair.

Figure 7:
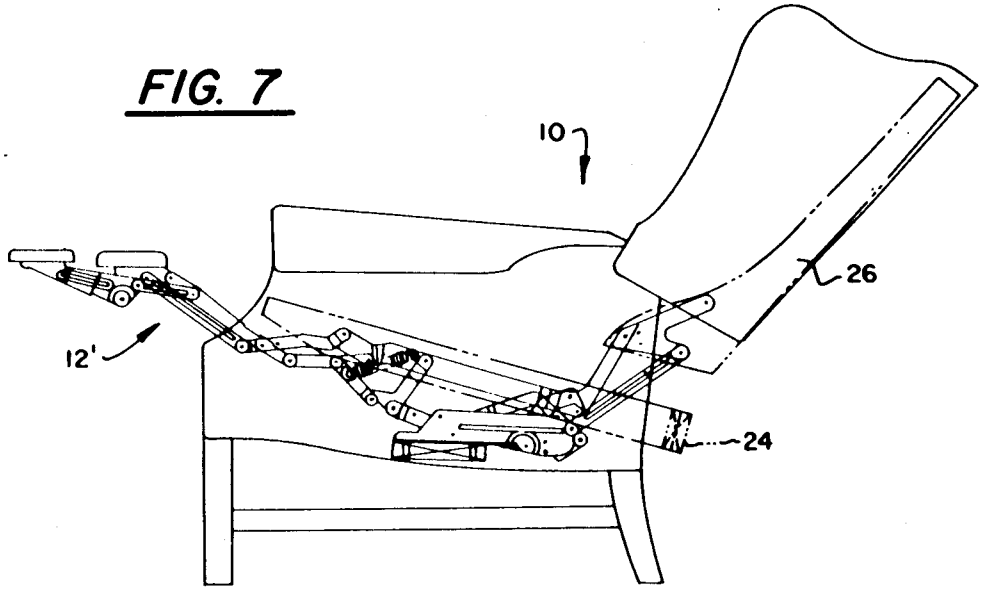
FIG. 7 is a side elevation view of the chair of FIG. 1, with its mechanisms in the two-way fully-reclined position shown in FIG. 6.

The difference in back to seat orientation between two-way and a three-way operation in the third (fully reclined) position can best be seen by comparing FIGS. 5 and 7.

(The mechanisms 12, 12' appear somewhat differently in FIGS. 5 and 7 than in FIGS. 2–4 and 6, because, in FIGS. 5 and 7, one is looking directly at the outboard side of a left side mechanism, rather than at the inboard side of a right side mechanism.)

It should now be apparent that the mechanism for high-leg reclining chair as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

I claim:

1. A mechanism for a high-leg recliner chair which, when mounted as a pair with a mirror-image duplicate thereof at the left and right between a chair base with generally horizontal, longitudinally extending left and right arms and a set of depending legs for supporting the chair on a floor, a seat, a back, and an ottoman, provides a push-on-the-arms-type of operation which permits the chair to have a fully erect position with the back up and ottoman retracted, a TV position with the back remaining at least somewhat erect but the ottoman extended, and a fully reclined position with the back more nearly tilted down at its top than in the TV position and the ottoman remaining extended, in which the mechanism, insofar as it is under the seat, is out of sight in use, and can be used to provide either two-way or three-way operation, by alternate positioning of a single pivot joint, said mechanism comprising:

a long upper longitudinal seat-mounting link; means for fastening the long upper longitudinal link to a respective side of said seat of the said chair; said long upper longitudinal link having a rear portion which projects upwardly thereby providing a spur;

a base-mounting bracket comprising a link folded along a longitudinal axis fold line so as to have an outboard, vertically oriented, longitudinally extending flange and a generally horizontal, inboard-extending flange at the lower extent of said vertically oriented flange; means for fastening said base mounting bracket to a respective side of said chair base; said vertically oriented flange being located inboard of a central portion of said long upper longitudinal link;

a V-shaped back-mounting link having forward leg and a rear leg which have respective upper ends and join at a lower end; a first transverse, horizontal axis pivot joint connecting said lower end of said back-mounting link to an upper end of said spur of said long upper longitudinal link; means for fastening said back-mounting link to a respective edge of a chair back;

a primary ottoman-mounting bracket comprising a link folded along a line which is substantially vertical when said ottoman is fully retracted, so as to have a rearwardly projecting longitudinal flange and, at a forward margin of said rearwardly projecting longitudinal flange, an inboard-projecting flange provided with means for fastening said primary ottoman-mounting bracket to a respective end of a primary ottoman;

a multiple-link lazy-tongs-type linkage provided at a front end of said seat-mounting link for mounting said primary ottoman-mounting bracket to said seat-mounting link; said linkage comprising an upper forward link, a lower forward link, an upper rear link and a lower rear link; said upper and lower forward links having respective forward ends connected, with vertical spacing between them, to said longitudinal flange of said primary ottoman-mounting bracket by respective second and third transverse, horizontal axis pivot joints; said upper and lower rear links having respective rear ends connected one in front of and above the other, to a forward end portion of said seat-mounting link by respective fourth and fifth pivot joints;

a sixth transverse, horizontal axis pivot joint is provided at a site where the upper forward link crosses the upper rear link, located part way down from the upper ends of these links; the lower front link having a lower end connected to a lower end of the upper rear link by a seventh transverse, horizontal axis pivot joint; a lower end of the upper front link being connected to a lower end of the lower rear link by an eighth transverse, horizontal axis pivot joint;

an inboard-extending pin provided on the upper rear link part way back from its upper end being available to engage an upper edge of the upper front link alternatively at two longitudinally spaced sites to provide respective stops limiting retraction and extension of the lazy tongs-type linkage as the primary ottoman is stowed and extended;

said seat-mounting link being provided with front and rear depending links respectively connected at upper ends thereof to the central portion of the seat-mounting link by a ninth transverse, horizontal axis pivot joint, and to the base of said spur near the rear end of the seat-mounting link by a tenth transverse, horizontal axis pivot joint;

the front depending link being generally L-shaped, with a depending stem and a lower leg projecting forwards; a forward end of the lower leg of the front depending link including an angled downwards toe on which is provided an eleventh transverse, horizontal axis pivot joint;

an ottoman lazy tongs operator link having a rear, lower end connected to the toe of the front depending link by said eleventh pivot joint and a front, upper end connected to a site on the lower rear link of the lazy tongs-type linkage part-way down from the upper end of said lower rear link, by a twelfth transverse, horizontal axis pivot joint, so that when the front depending link swings forwards about its upper end, said operator link has its rear, lower end pushed towards the fourth and fifth pivot joints by which the upper and lower rear links are connected to the seat-mounting link, thereby extending the lazy tongs-type linkage and thrusting the primary ottoman, with a reverse sequence happening as the front depending link swings rearwards about its upper end;

above said first pivot joint, said back-mounting link being provided with an inboard-projecting pin which is available to engage a rear edge of said spur above said first pivot joint as the chair is erected, for defining the location of the back in the fully erect position of the chair and helping to maintain the back tightly in place in a closed position of the mechanism;

an operator link for the back-mounting link; said back-mounting link operator link having an upper end connected to the upper end of the rear leg of the back-mounting link by a thirteenth transverse, horizontal axis pivot joint, and a lower end connected to the rear end of the vertical, longitudinal flange of the base-mounting bracket by a fourteenth transverse, horizontal axis pivot joint so that when the base-mounting bracket translates forwards relative to the seat-mounting link, and the latter tips upwards to the front slightly as the mechanism opens from a fully closed to a TV position, the back-mounting link operator link mainly merely pivots forwards around its upper end, but also is pulled slightly downwards in a translational sense, so that the back-mounting link tilts slightly to the rear, thus slightly tilting the back of the chair;

the upper end of the rear depending link being provided with a rearwardly extending prong; the seat-mounting link being provided at the base of the spur, behind and below the tenth pivot joint connecting the upper end of the rear depending link to the seat-mounting link, with an inboards-extending pin which is engageable with a lower edge of said prong to limit forwards swinging of the rear depending link, and therefore the front depending link and the seat-mounting bracket, relative to the seat-mounting link, as the mechanism opens from the closed to the TV position thereof;

a longitudinally short contral link connected by an upper, rear end thereof to the vertical longitudinal flange of the base-mounting bracket part way forwards from the rear end of the base-mounting bracket, below the inboards-extending flange of the base-mounting bracket, by a fifteenth transverse, horizontal axis pivot joint; and outer portion of said short control link being provided with a slot, elongated along the length of said short control link, and a sliding, pivotal connection being provided between such portion and the lower end of the rear depending link by a sixteenth transverse, horizontal axis pivot joint which can slide along said slot, so that when the mechanism is closed, the short control link projects downwards and slightly forwards and the sixteenth pivot joint is located at the upper end of the slot, as the mechanism opens from the closed position to the TV position, the short control link pivots forwards about its upper end as the sixteenth pivot joint slides to the bottom of the slot;

three arcuate-shaped links, namely a forward long arcuate link, which is concave upwards, a rear long arcuate link, which is concave downwards, and, under the rear half of the rear long arcuate link, a rear short arcuate link, which is concave upwards;

the forward, upwardly concave arcuate link being connected in a central elbow region thereof to the vertical longitudinal flange of the base-mounting bracket near the fold line of the base-mounting bracket, part-way back from the front end of the base-mounting bracket, by a seventeenth transverse, horizontal axis pivot joint;

the front end of the forward long arcuate link being connected to a base of an upright standard of the front depending link by an eighteenth transverse, horizontal axis pivot joint;

an inboards-projecting pin provided on a front arm of the forward long arcuate link part-way forwards along that arm from the seventeenth pivot joint, so as to engage in the closed and TV positions of the mechanism on a recessed upper edge region of the vertical longitudinal flange of the seat-mounting bracket;

a forward end of the rear short upwardly concave link being connected to the rear depending link part-way up from the lower end of the latter, by a nineteenth transverse, horizontal axis pivot joint;

the rear short upwardly concave link being provided so as to remain substantially immobile as the mechanism moves between its fully closed and TV positions, with an outboards-projecting pin provided on the vertical, longitudinal flange of the base-mounting bracket engaging a lower edge of the rear, short upwardly concave link behind the fifteenth pivot joint;

the rear long arcuate link having a rear end connected to the rear end of the rear short upwardly concave link by a twentieth transverse horizontal axis pivot joint and a front end connected to the rear end of the forward concave-upwards arcuate link by a twenty-first transverse, horizontal axis pivot joint; said three arcuate links being provided so as to remain substantially immobile as the mechanism moves between its closed and TV positions, and, as the mechanism moves from the TV position to the fully reclined position, the forward, upwardly arcuate link being arranged to rock towards the rear about said seventeenth pivot joint, thus raising the front of the seat-mounting link relative to the base-mounting bracket, shifting the rear, downwardly concave link rearwards, thereby raising the rear of the seat-mounting link, the raising of the rear of the seat-mounting link pulling down the lower end of the back-operating link, thereby fully reclining the chair back; and a tension coil spring mounted between two pins respectively provided on the seat-mounting link ahead of the ninth pivot joint and an intermediate location on the ottoman lazy tongs operator link acts as the primary ottoman is retracted to keep the primary ottoman firmly retracted in its stowed position;

said mechanism being adaptable to two alternative uses to provide either two-way operation in which the angle between the seat and back remains substantially constant as the mechanism moves from its TV position to its fully reclined position and back, or three-way operation in which the angle between the seat and back increases as the mechanism moves from its TV position to its fully reclined position and decreases as the mechanism moves from its fully reclined position to its TV position, by further including:

a first pair of transverse, horizontal axis openings respectively provided through said rear short upwardly concave arcuate link at a central bend thereof and the vertical, longitudinal flange of said base-mounting bracket at the rear end of the latter, below the connection of the lower end of the back-operating link to that flange; said openings of said first pair being axially aligned transversally of the mechanism when said mechanism is in said closed and TV positions thereof;

a second pair of transverse, horizontal axis openings respectively provided through said rear short upwardly concave arcuate link approximately midway between said nineteenth pivot joint and the respective said opening of said first pair through said rear short upwardly concave arcuate link, and the vertical, longitudinal flange of said base-mounting bracket; said openings of said second pair being axially aligned transversally of the mechanism when said mechanism is in said closed and TV positions thereof; and a twenty-second transverse, horizontal axis pivot joint installed through one of said first and second pairs of transverse, horizontal axis openings.

2. The mechanism of claim 1, further including:

a secondary ottoman mounting bracket comprising a link folded along a longitudinal fold line so as to have an elongated, vertical plane flange and its rear third, in the closed position of said mechanism, an inboard-extending flange; fastening means provided on said inboard-extending flange for mounting a respective end of the secondary ottoman thereto;

below where the upper end of the lower front link mounts to the longitudinal flange of the primary ottoman-mounting bracket, a twenty-third transverse, horizontal axis pivot joint connecting a heel of a foot of said longitudinal flange of said secondary ottoman-mounting bracket to said primary ottoman-mounting bracket;

a secondary ottoman operator link having one end connected by a twenty-fourth transverse, horizontal axis pivot joint to a toe of said foot of said longitudinal flange of said secondary ottoman-mounting bracket, at a location that is spaced generally directly vertically below said twenty-third pivot joint when said mechanism is in said closed position; said secondary ottoman operator link having an opposite end connected by a twenty-fifth pivot joint to the upper front link part-way back from the front end of the upper front link, so that as the primary ottoman is extended from a stowed, on edge, location under a front edge of the seat, the secondary ottoman operator link swings the secondary ottoman bracket through approximately one hundred eight degrees from holding the secondary ottoman located face down behind the primary ottoman, to being located face up and in a common, slightly tilted forward plane with the primary ottoman, forwardly of the primary ottoman.

3. A high-leg recliner chair, comprising:

a chair base with generally horizontal, longitudinally extending left and right arms and a set of depending legs for supporting the chair on a floor; a seat; a back; an ottoman which includes a primary ottoman; and a pair of mirror-image mechanisms provided respectively at the left and right of the chair and being mounted to respective portions of said chair base, said seat, said back and said primary ottoman, for providing a push-on-the-arms-type of operation which permits the chair to have a fully erect position with the back up and ottoman retracted, a TV position with the back remaining at least somewhat erect but the ottoman extended, and a fully reclined position with the back more nearly tilted down at its top than in the TV position and the ottoman remaining extended, in which the mechanism, insofar as it is under the seat, is out of sight in use, and can be used to provide either two-way or three-way operation, by alternate positioning of a single pivot joint, each said mechanism comprising:

a long upper longitudinal seat-mounting link; means for fastening the long upper longitudinal link to a respective side of said seat of the said chair; said long upper longitudinal link having a rear portion which projects upwardly thereby providing a spur;

a base-mounting bracket comprising a link folded along a longitudinal axis fold line so as to have an outboard, vertically oriented, longitudinally extending flange and a generally horizontal, inboard-extending flange at the lower extent of said vertically oriented flange; means for fastening said base mounting bracket to a respective side of said chair base; said vertically oriented flange being located inboard of a central portion of said long upper longitudinal link;

a V-shaped back-mounting link having forward leg and a rear leg which have respective upper ends and join at a lower end; a first transverse, horizontal axis pivot joint connecting said lower end of said back-mounting link to an upper end of said spur of said long upper longitudinal link; means for fastening said back-mounting link to a respective edge of a chair back;

a primary ottoman-mounting bracket comprising a link folded along a line which is substantially vertical when said ottoman is fully retracted, so as to have a rearwardly projecting longitudinal flange and, at a forward margin of said rearwardly projecting longitudinal flange, an inboard-projecting flange provided with means for fastening said primary ottoman-mounting bracket to a respective end of a primary ottoman;

a multiple-link lazy-tongs-type linkage provided at a front end of said seat-mounting link for mounting said primary ottoman-mounting bracket to said seat-mounting link; said linkage comprising an upper forward link, a lower forward link, an upper rear link and a lower rear link; said upper and lower forward links having respective forwards ends connected, with vertical spacing between them, to said longitudinal flange of said primary ottoman-mounting bracket by respective second and third transverse, horizontal axis pivot joints; said upper and lower rear links having respective rear ends connected one in front of and above the other, to a forward end portion of said seat-mounting link by respective fourth and fifth pivot joints;

a sixth transverse, horizontal axis pivot joint is provided at a site where the upper forward link crosses the upper rear link, located part way down from the upper ends of these links; the lower front link having a lower end connected to a lower end of the upper rear link by a seventh transverse, horizontal axis pivot joint; a lower end of the upper front link being connected to a lower end of the lower rear link by an eighth transverse, horizontal axis pivot joint;

an inboard-extending pin provided on the upper rear link part way back from its upper end being available to engage an upper edge of the upper front link alternatively at two longitudinally spaced sites to provide respective stops limiting retraction and extension of the lazy tongs-type linkage as the primary ottoman is stowed and extended;

said seat-mounting link being provided with front and rear depending links respectively connected at upper ends thereof to the central portion of the seat-mounting link by a ninth transverse, horizontal axis pivot joint, and to the base of said spur near the rear end of the seat-mounting link by a tenth transverse, horizontal axis pivot joint;

the front depending link being generally L-shaped, with a depending stem and a lower leg projecting forwards; a forward end of the lower leg of the front depending link including an angled downwards toe on which is provided an eleventh transverse, horizontal axis pivot joint;

an ottoman lazy tongs operator link having a rear, lower end connected to the toe of the front depending link by said eleventh pivot joint and a front, upper end connected to a site on the lower rear link of the lazy tongs-type linkage part-way down from the upper end of said lower rear link, by a twelfth transverse, horizontal axis pivot joint, so that when the front depending link swings forwards about is upper end, said operator link has its rear, lower end pushed towards the fourth and fifth pivot joints by which the upper and lower rear links are connected to the seat-mounting link, thereby extending the lazy tongs-type linkage and thrusting the primary ottoman, with a reverse sequence happening as the front depending link swings rearwards about its upper end;

above said first pivot joint, said back-mounting link being provided with an inboard-projecting pin which is available to engage a rear edge of said spur above said first pivot joint as the chair is erected, for defining the location of the back in the fully erect position of the chair and helping to maintain the back tightly in place in closed position of the mechanism;

an operator link for the back-mounting link; said back-mounting link operator link having an upper end connected to the upper end of the rear leg of the back-mounting link by a thirteenth transverse, horizontal axis pivot joint, and a lower end connected to the rear end of the vertical, longitudinal flange of the base-mounting bracket by a fourteenth transverse, horizontal axis pivot joint so that when the base-mounting bracket translates forwards relative to the seat-mounting link, and the latter tips upwards to the front slightly as the mechanism opens from a fully closed to a TV position, the back-mounting link operator link mainly merely pivots forwards around its upper end, but also is pulled slightly downwards in a translational sense, so that the back-mounting link tilts slightly to the rear, thus slightly tilting the back of the chair;

the upper end of the rear depending link being provided with a rearwardly extending prong; the seat-mounting link being provided at the base of the spur, behind and below the tenth pivot joint connecting the upper end of the rear depending link to the seat-mounting link, with an inboards-extending pin which is engageable with a lower edge of said prong to limit forwards swinging of the rear depending link, and therefore the front depending link and the seat-mounting bracket, relative to the seat-mounting link, as the mechanism opens from the closed to the TV position thereof;

a longitudinally short control link connected by an upper, rear end thereof to the vertical longitudinal flange of the base-mounting bracket part way forwards from the rear end of the base-mounting bracket, below the inboards-extending flange of the base-mounting bracket, by a fifteenth transverse, horizontal axis pivot joint, an outer portion of said short control link being provided with a slot, elongated along the length of said short control link, and a sliding, pivotal connection being provided between such portion and the lower end of the rear depending link by a sixteenth transverse, horizontal axis pivot joint which can slide along said slot, so that when the mechanism is closed, the short control link projects downwards and slightly forwards and the sixteenth pivot joint is located at the upper end of the slot, as the mechanism opens from the closed position to the TV position, the short control link pivots forwards about its upper end as the sixteenth pivot joint slides to the bottom of the slot;

three arcuate-shaped links, namely a forward long arcuate link, which is concave upwards, a rear long arcuate link, which is concave downwards, and, under the rear half of the rear long arcuate link, a rear short arcuate link, which is concave upwards;

the forward, upwardly concave arcuate link being connected in a central elbow region thereof to the vertical longitudinal flange of the base-mounting bracket near the fold line of the base-mounting bracket, part-way back from the front end of the base-mounting bracket, by a seventeenth transverse, horizontal axis pivot joint;

the front end of the forward long arcuate link being connected to a base of an upright standard of the front depending link by an eighteenth transverse, horizontal axis pivot joint;

an inboards-projecting pin provided on a front arm of the forward long arcuate link part-way forwards along that arm from the seventeenth pivot joint, so as to engage in the closed and TV positions of the mechanism on a recessed upper edge region of the vertical longitudinal flange of the seat-mounting bracket;

a forward end of the rear short upwardly concave link being connected to the rear depending link part-way up from the lower end of the latter, by a nineteenth transverse, horizontal axis pivot joint;

the rear short upwardly concave link being provided so as to remain substantially immobile as the mechanism moves between its fully closed and TV positions, with an outboards-projecting pin provided on the vertical, longitudinal flange of the base-mounting bracket engaging a lower edge of the rear, short upwardly concave link behind the fifteenth pivot joint;

the rear long arcuate link having a rear end connected to the rear end of the rear short upwardly concave link by a twentieth transverse horizontal axis pivot joint and a front end connected to the rear end of the forward concave-upwards arcuate link by a twenty-first transverse, horizontal axis pivot joint; said three arcuate links being provided so as to remain substantially immobile as the mechanism moves between its closed and TV positions, and, as the mechanism moves from the TV position to the fully reclined position, the forward, upwardly arcuate link being arranged to rock towards the rear about said seventeenth pivot joint, thus raising the front of the seat-mounting link relative to the base-mounting bracket, shifting the rear, downwardly concave link rearwards, thereby raising the rear of the seat-mounting link, the raising of the rear of the seat-mounting link pulling down the lower end of the back-operating link, thereby fully reclining the chair back; and a tension coil spring mounted between two pins respectively provided on the seat-mounting link ahead of the ninth pivot joint and an intermediate location on the ottoman lazy tongs operator link acts as the primary ottoman is retracted to keep the primary ottoman firmly retracted in its stowed position;

said mechanism being adaptable to two alternative uses to provide either two-way operation in which the angle between the seat and back remains substantially constant as the mechanism moves from its TV position to its fully reclined position and back, or three-way operation in which the angle between the seat and back increases as the mechanism moves from its TV position to its fully reclined position and decreases as the mechanism moves from its fully reclined position to its TV position, by further including:

a first pair of transverse, horizontal axis openings respectively provided through said rear short upwardly concave arcuate link at a central bend thereof and the vertical, longitudinal flange of said base-mounting bracket at the rear end of the latter, below the connection of the lower end of the back-operating link to that flange; said openings of said first pair being axially aligned transversally of the mechanism when said mechanism is in said closed and TV positions thereof;

a second pair of transverse, horizontal axis openings respectively provided through said rear short upwardly concave arcuate link approximately midway between said nineteenth pivot joint and the respective said opening of said first pair through said rear short upwardly concave arcuate link, and the vertical, longitudinal flange of said base-mounting bracket; said openings of said second pair being axially aligned transversally of the mechanism when said mechanism is in said closed and TV positions thereof; and a twenty-second transverse, horizontal axis pivot joint installed through one of said first and second pairs of transverse, horizontal axis openings.

4. The high-leg recliner chair of claim 3, further including:

a secondary ottoman;

a secondary ottoman mounting bracket comprising a link folded along a longitudinal fold line so as to have an elongated, vertical plane flange and its rear third, in the closed position of said mechanism, an inboard-extending flange; fastening means provided on said inboard-extending flange for mounting a respective end of the secondary ottoman thereto;

below where the upper end of the lower front link mounts to the longitudinal flange of the primary ottoman-mounting bracket, a twenty-third transverse, horizontal axis pivot joint connecting a heel of a foot of said longitudinal flange of said secondary ottoman-mounting bracket to said primary ottoman-mounting bracket;

a secondary ottoman operator link having one end connected by a twenty-fourth transverse, horizontal axis pivot joint to a toe of said foot of said longitudinal flange of said secondary ottoman-mounting bracket, at a location that is spaced generally directly vertically below said twenty-third pivot joint when said mechanism is in said closed position; said secondary ottoman operator link having an opposite end connected by a twenty-fifth pivot joint to the upper front link part-way back from the front end of the upper front link, so that as the primary ottoman is extended from a stowed, on edge, location under a front edge of the seat, the secondary ottoman operator link swings the secondary ottoman bracket through approximately one hundred eight degrees from holding the secondary ottoman located face down behind the primary ottoman, to being located face up and in a common, slightly tilted forwards plane with the primary ottoman, forwardly of the primary ottoman.

* * * * *